United States Patent [19]

Miles

[11] Patent Number: 4,825,047

[45] Date of Patent: Apr. 25, 1989

[54] TEMPERATURE-RESPONSIVE CONTROLLER FOR WATERBED MATTRESS HEATERS

[75] Inventor: Floyd D. Miles, Molalla, Oreg.

[73] Assignee: Thermafoil Products Inc., El Monte, Calif.

[21] Appl. No.: 46,870

[22] Filed: May 7, 1987

[51] Int. Cl.[4] ..... H05B 1/02

[52] U.S. Cl. ..... 219/496; 219/419; 219/509; 5/422; 337/322; 236/57

[58] Field of Search ..... 219/496, 509, 510, 513, 219/494, 212, 506, 497; 5/421, 422, 451; 236/30, 57; 337/322, 323, 319, 327; 338/3-5

[56] References Cited

U.S. PATENT DOCUMENTS

| | | | |
|---|---|---|---|
| 3,617,972 | 11/1971 | Branson | 337/323 |
| 3,873,808 | 3/1975 | Patton | 219/512 |
| 3,924,142 | 12/1975 | Holtkamp | 307/116 |
| 3,988,577 | 10/1976 | Leitner et al. | 219/506 |
| 4,352,976 | 10/1982 | McMullan | 219/217 |
| 4,490,708 | 12/1984 | Thompson et al. | 337/320 |
| 4,626,819 | 12/1986 | Drapeau | 337/323 |
| 4,700,168 | 10/1987 | Sirois et al. | 337/327 |

FOREIGN PATENT DOCUMENTS

| | | |
|---|---|---|
| 0441177 | 10/1972 | Australia . |
| 3041214 | 6/1982 | Fed. Rep. of Germany . |
| 3125595 | 1/1983 | Fed. Rep. of Germany . |

*Primary Examiner*—M. H. Paschall

*Attorney, Agent, or Firm*—Georges A. Maxwell

[57] ABSTRACT

A controller for an electric resistance waterbed mattress heater supplied with electric current by an elongate power cord extending between the heater and a power service outlet. The controller includes a small diameter elongate cylindrical housing in which an adjustable on and off switch is mounted and into which the cord is extended and connected with the switch. The switch includes a Bourdon tube to actuate the switch between opened and closed positions when the tube is caused to deflect by changes of pressure therein. A capillary tube is connected with and extends from the Bourdon tube to the exterior of the housing and about which it is formed and supported. An adjusting knob is positioned at one end of the body and is coupled with a part of the switch to move switch parts relative to each other and to the Bourdon tube to adjust and set the operating position of parts of the switch.

14 Claims, 3 Drawing Sheets

40
N
40'
K
39
93
92
90
O
35
38
31
37
C
41
5
60
36
62
95
73
70
F
91
72
61
30
88
71
69
S
87
83
67
X
75
80
B
81
79
66
H
76
77
65
85
63
86
T
43'
43
44
68
102
105
Z
Y
32
46
48
24
55
6
47
P
33
53
21
49
50
50

N
90
60
95
91
70
73
61
88
71
67
S
83
87
75
80
81
76
B
85
65
86
82
78

TEMPERATURE-RESPONSIVE CONTROLLER FOR WATERBED MATTRESS HEATERS

This invention has to do with an improved temperature-responsive controller for waterbed mattress heaters which is responsive to the temperature of a waterbed mattress in a related waterbed structure and which operates to start and stop the flow of electric current between an electric resistance heater positioned within the waterbed structure and a power service outlet remote from the waterbed structure.

BACKGROUND OF THE INVENTION

In the art of waterbeds, water-filled bladder-like mattresses are supported atop platforms and are retained about their perimeters by vertical frames projecting up from the platforms which normally including head, foot and side boards or retaining walls. To maintain the water-filled mattresses at comfortable temperatures, flat, blanket-type resistance heaters are positioned flat between the platforms and the bottom surfaces of the mattresses. The heaters are supplied with electric current by service cords that extend from the heaters, between the mattresses and platforms, upwardly between the mattresses and the retaining walls, over said retaining walls and thence to power service outlets.

It is common practice to turn the heaters in waterbeds on and off to establish and maintain the mattresses at desired set temperatures. To this end, manually-adjustable thermally-responsive on and off switch means are provided in one of the pair of conductors of the power cords for such heaters. The most common and widely used thermally-responsive on and off switching means provided by the prior art comprises a manually-adjustable on and off snap action-type switch arranged in a large housing or case that can be arranged outside of and remote from its related waterbed structure, away from the large volume of water within the waterbed structure, for obvious safety reasons. The switch is controlled (opened and closed) by a diaphragm-type fluid pressure actuating device connected with an elongate capillary tube that extends from the case and into the waterbed structure, between the platform and mattress, where it is provided with a large bulb. That is, a common bulb and capillary tube is used. The housings for such devices are engaged about their related power cords between the ends thereof.

The great problem with the above noted type of class of control means resides in the fact that the dispositioning of the portions of the power cords extending from the heaters to the housings and dispositioning of the elongate capillary tubes extending from the housings into the waterbed structures create dangerous and unsightly obstructions, are subject to being damaged. They frequently prevent desired convenient and attractive placement of the housings. Irreparable damage to the elongate, exposed and unprotected portions of the capillary tubes of such control devices is the single most common problem and is a problem which is frequently not understood or recognized. When a capillary tube for such control means is damaged and the control means fails to function properly, malfunctioning of the control means is most often attributed to the failure of some part or portion of a controller within the controller housing and/or to an inferior quality of the control means as a whole.

To overcome the above and other undesirable characteristics and features of the above noted common-type or class of waterbed heater control means, the prior art has offered waterbed heaters with pre-set temperature-responsive control switches incorporated in them and have used other, more sophisticated electric or electronic temperature-sensing means in place of the common capillary and bulb-type means. While such diverse and alternate means have worked or shown promise, they have presented unique problems and shortcomings of their own and have, therefore, failed to supplant or become recognized as equal to or better than the first above noted common-type or class of control means.

It has been determined and is readily recognizable that the great majority of shortcomings found to exist in common present day waterbed mattress controllers would be eliminated and greatly reduced if:

(1) the need for and use of bulb and capillary tube units with elongate, freely-extending capillary tubes was eliminated; and, (2) if the controller housings were to be made adequately waterproof and sufficiently small that they could be safely and conveniently placed within related waterbed structures, as between a retaining wall thereof and the mattress, rather than between the ends of an elongate, slack and unrestrained portion of the heater power cord extending freely from within and outside of the bed structure.

OBJECTS AND FEATURES OF MY INVENTION

It is an object of my invention to provide an improved, thermally-responsive adjustable waterbed heater controller, hereinafter called the controller, that is sufficiently waterproof and sufficiently small that it can be safely arranged and positioned between a retaining wall and an adjacent side of the mattress of a related waterbed structure without the likelihood of damaging, distorting or otherwise adversely affecting the mattress or any part or portion of the waterbed structure.

It is an object and a feature of my invention to provide a controller of the general character referred to above which includes an elongate, preferably cylindrical housing, engaged in and connected to an elongate waterbed heater power cord, between the ends thereof, and which is and need not be greater than four (4) inches long and one (1) inch in diameter; which is free of any sharp corners, edges and the like which might damage a waterbed mattress and which is sufficiently waterproof so that it is easily, safely and conveniently normally positioned between a side of a waterbed mattress and its adjacent retaining wall of a related waterbed structure.

It is another object and feature of my invention to provide a controller of the general character referred to above which includes a short, fluid-filled capillary tube engaged about the exterior of and supported by the housing so that a substantial portion of said tube is in heat-conducting contact with a surface of a waterbed mattress adjacent which the housing is positioned and held.

A further object and feature of my invention is to provide a controller of the general character referred to above which includes a fluid-filled Bourdon tube connected with the capillary tube and positioned within the housing and a controller with a normally open on and off switch within the housing and operatively related to the Bourdon tube, to be opened and closed thereby upon deflection of the Bourdon tube resulting from temperature-induced changes of fluid pressure therein.

Still another object and feature of my invention is to provide a controller of the general character referred to above wherein the on and off switch is a variable snap action-type switch and is adjusted and set by an eccentric part on a shaft sealingly-engaged through an opening at one end of the housing and on which a manually-engageable cylindrical and rounded operating knob is carried; and, wherein a portion of the waterbed heater power cord is made to enter and exit the other or opposite end of the housing where it is connected with terminal posts of the on and off switch and in which it is sealingly anchored by a suitable potting compound.

It is another object and feature of my invention to provide a controller of the general character referred to above wherein the switch structure and adjusting means therefor, the Bourdon tube, capillary tube and certain of the other parts of the controller structure are uniquely designed, assembled and arranged so that they can be effectively positioned within the confines of and carried by the short, small diameter, tubular housing that I provide.

It is an object and feature of my invention to provide a novel controller of the general character referred to above which is particularly adapted to being positioned vertically between a side of a related waterbed mattress and its related retaining wall with its end at which the control knob occurs disposed upwardly for easy and convenient viewing and manual engagement from atop the waterbed.

It is another object and feature of my invention to provide a housing for a controller of the character referred to above with a radially, outwardly-opening annular hangar-receiving groove and to provide an elongate, vertical hangar part with a lower loop engaged in the groove in the housing and an upper hook engageable over a retaining wall of a related waterbed to releasably support the housing in desired and convenient position in the waterbed structure.

Finally, it is an object and a feature of my invention to provide a controller of the general character referred to above which lends itself to being mass produced and sold at low cost and which is highly effective and dependable to serve its intended function and to attain its intended ends.

The foregoing and other objects and features of my invention will be apparent and will be fully understood from the following detailed description of a typical preferred form and embodiment of my invention throughout which description reference is made to the accompanying drawings.

DETAILED DESCRIPTION OF THE INVENTION

Figure 1:
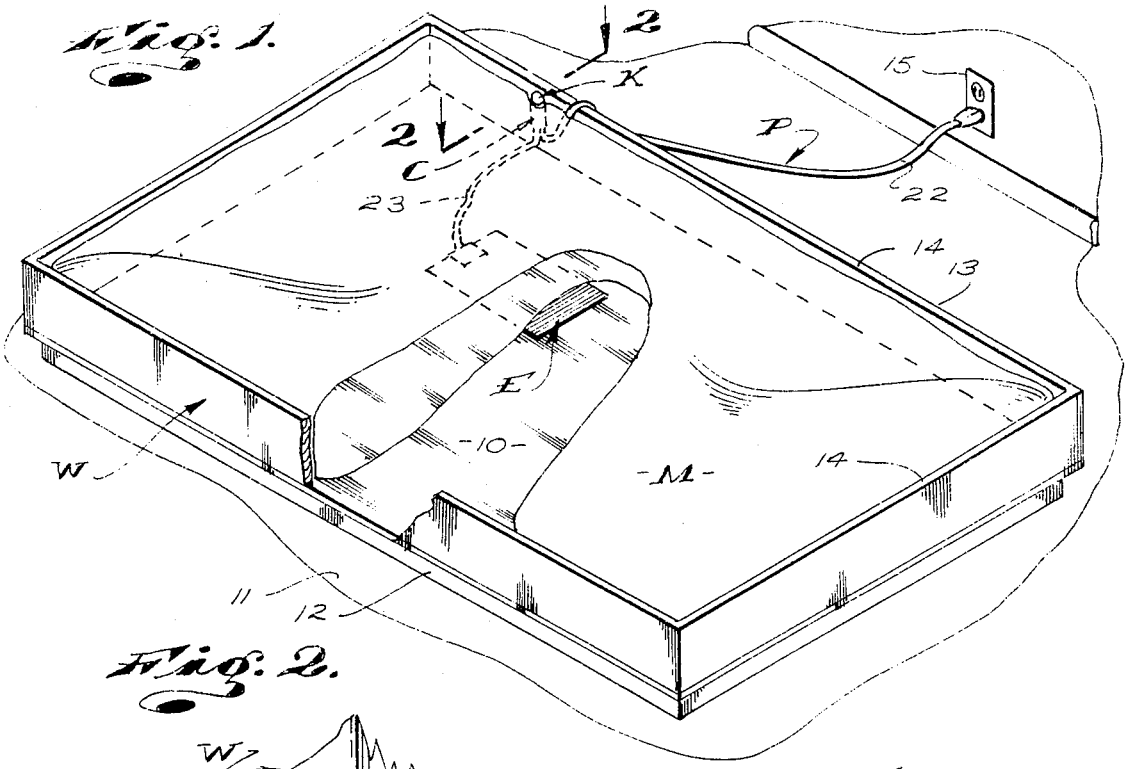
FIG. 1 is an isometric view of a waterbed structure with my new controller related to it.

In FIG. 1 of the drawings I have shown a typical waterbed structure W. The waterbed structure W includes a flat, horizontal, rectangular mattress-supporting platform 10. The platform is shown supported atop a deck or floor 11 by a suitable pedestal structure 12. The platform 10 is provided with and carries a plurality of vertically-projecting mattress-engaging retaining boards or walls 13 about its perimeter. The boards 13 have straight, horizontal upper edges 14. In the case illustrated, there are four boards 13, there being a head board, foot board, and 2 side boards.

Within the retaining boards 13 and atop the platform 10 is a waterbed mattress M. The bladder-like mattress M defines horizontal top and bottom walls and vertical side walls. The mattress M is made of thin, polyvinylchloride plastic sheet stock and is filled with or contains a volume of water sufficient to afford flotation for a person's body resting atop the mattress and to afford the top surface or wall of the mattress with sufficient and desired working slack.

The waterbed structure thus far described and illustrated is a typical or basic form of waterbed that all in the art are familiar with.

In practice, it is common practice to provide a sheet plastic liner between the mattress M and its related surfaces of the platform and retaining boards. Such a liner is optional and since such a liner would in no way affect the novelty of my invention, I have elected not to show the bed structure A with such a liner.

The waterbed structure W next includes a flat, horizontal blanket-type electric resistance heater E positioned in flat supported engagement atop the platform 10 and below the bottom wall of the mattress M in heat-conducting contact therewith. The heater E is supplied with electric power through a tube conductor power cord P. The cord P extends from the heater between the mattress and the platform, up between the mattress and a retaining board 13, over the upper edge 14 of that board, and thence to a remote power service outlet 15. In practice, the power cord is sufficiently long to provide a substantial degree of slack and play between the bed structure W and the outlet 15.

The heater E, when energized, heats the mattress M, the volume of water therein and the whole of the bed structure to a desired temperature which affords body comfort for the persons using the bed.

It is common practice to provide temperature-responsive, adjustable power control means to start and stop the flow of current to and from the heater E and to automatically maintain the temperature of the bed structure at a desired set temperature. Most such means or devices provided by the prior art have been characterized by box-like control units engaged in the portions of the power cords for the heaters that extend from the waterbeds to the power service outlets. They are positioned in the power cords where they are spaced a safe distance away from and clear of the waterbeds and the volumes of water within the beds, should the mattresses rupture and cause flooding of the area about the beds. Most such means and devices provided by the prior art have elongate capillary tubes of malleable metal that extend freely from the control box units. The outer end portions of the capillary tubes are extended into the bed structures to occur beween the mattresses and the platforms. The tubes have bulbs at their outer free ends which contact the mattress. The inner or opposite ends of the prior art capillary tubes extend into their related control box units and are connected with diaphragm-type switch-actuating devices within the control boxes. The switch-actuating devices are related to switches within the boxes the switches are connected in and with one of the conductors of the power cords, within the boxes.

The controller C that I have invented and which is shown in the drawings serves to attain a similar end result as do the prior art control means and devices briefly described in the foregoing, but unlike the prior art means and devices, is sufficiently small and is so shaped that it is particularly suited and adapted to be arranged and positioned within its related waterbed structure between a side of the mattress M and a related retaining board 13 whereby the controller is not positioned outside of and remote from the bed structure where it is: (1) unsightly; (2) is an inherent obstruction; and, (3) is particularly subect to being damaged. Further, in my new controller C there is no elongate, freely extending, exposed, unsightly, easy to catch and damage capillary tube as is commonly found in and that characterizes those control means and devices provided by the prior art.

The controller C that I provide is a short, cylindrical unit which need be no greater than three and a half ($3\frac{1}{2}$) inches in length and no greater than one and one-sixteenth (1 1/16) inch in diameter. The controller unit is of such size and shape that it can be engaged between and supported by the side wall of a related mattress M and its related vertical retaining board is without adversely distorting the mattress and without the likelihood of damaging the mattress or of being damaged in the course of its being put ot its intended use, under all normal and anticipated operating conditions.

Figure 2:
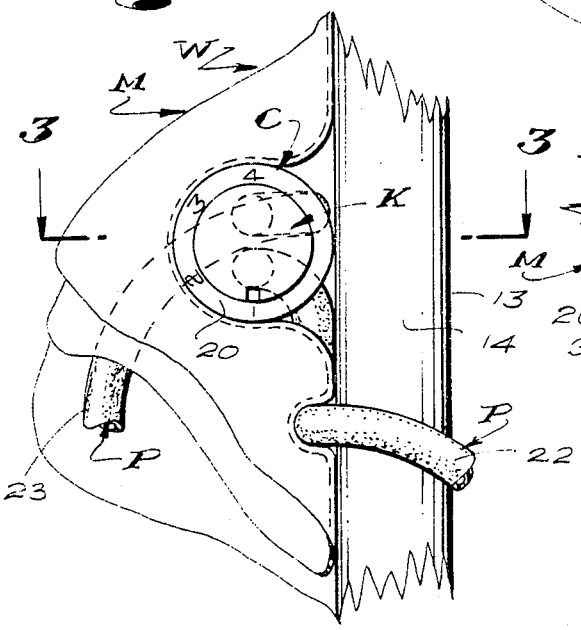
FIG. 2 is an enlarged view of a portion of the structure shown in FIG. 1 and taken as indicated by line 2—2 on FIG. 1.
Figure 3:
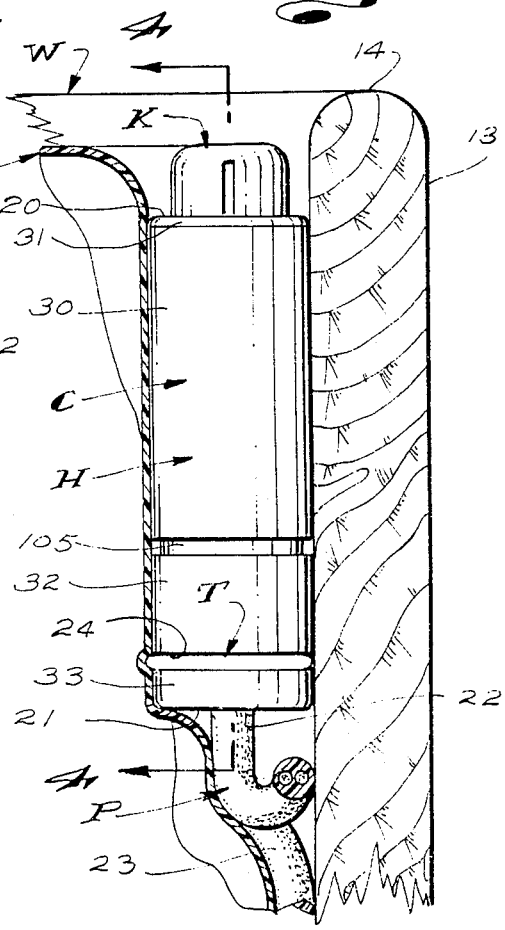
FIG. 3 is a view taken as indicated by line 3—3 on FIG. 2.

In practice and use my new unitary controller is arranged vertically between its related side wall of the mattress and related retaining board with its upper end at or close to the top wall or plane of the mattress where it can be easily and conveniently viewed and where ready and convenient access to it is afforded (seen FIGS. 1, 2, and 3 of the drawings).

In my new controller C only the service outlet end portion of the power cord P extends from within and thereafter extends freely from the waterbed structure. My new controller includes an elongate, vertically-extending cylindrical housing H with upper and lower ends 20 and 21. A small, rounded, cylindrical adjusting knob K is positioned at and is accessible at the upper end 20 of the housing. The power cord P has an intermediate portion engaged within the housing and has opposite end portions 22 and 23 extending from the lower end of the housing to the power service outlet 15 and to the heater E, as clearly shown in the drawings.

My new controller C is next characterized by an exterior, visible and accessible free end portion 24 of an elongate capillary tube T. The portion 24 of the tube T is engaged about the exterior of and carried by the housing H at the lower end portion thereof where the side wall of the waterbed mattress conforms to and is in engagement about the housing and where the establishing of heat-conducting contact of the mattress with the capillary tube is assured.

It is to be particulary noted that the capillary tube is established of malleable copper having a high index of heat conductivity and that, with my new controller, it is only necessary that the mattress M contact about one-quarter ($\frac{1}{4}$) of the circumference of the portion 24 of the tube along approximately three-quarter ($\frac{3}{4}$) inches of the tube to assure proper and desired operation of my controller.

This is made possible by the fact that the controller is positioned within the waterbed structure where it is protected from drafts and other environmental conditions that might adversely affect its operation. The controller, as a whole, is a heat sink or storage unit within the heated waterbed structure and is normally maintained at the same temperature as the waterbed structure. Accordingly, the capillary tube T need only be made to function in response to temperature changes at and within the waterbed structure and can be and is made to be highly responsive to slight temperature variations within the bed structure. It is to be noted that the above is not true in the case of prior art control means and device where long portions of the freely-extending capillary tubes are exposed to the ambient environment and where bulbs must be provided at the ends of those tubes to attains satisfactory end results.

The controller C next includes a novel, manually-adjustable on and off switch structure S specially designed and constructed to be arranged within and carried by the small diameter housing H. The switch structure S is designed to be operatively coupled with the operating knob K at the upper end of the housing and to connect with one of the conductors of the power cord P entering and exiting the lower end of the housing.

Finally, the controller includes a fluid pressure-actuated switch-operating device B structurally incorporated in and carried by the switch structure S and connected with the capillary tube T. The device B is a rugged, dependable and highly-responsive Bourdon tube and is distinguishable from fluid pressure-actuated diaphragm-type switch-actuating means used in the prior art and which are more fragile, less accurate and dependable, and which require the movement of large volumes of fluid to affect their operation.

The housing structure H that I provide is an elongate, vertically-extending sectional structure that defines an upper closed switch chamber X and a lower chamber Y accommodating the switch terminal posts, cable, cable connectors, and in and through which the capillary tube T is extended. The chamber Y is filled with potting compound Z to securely anchor and hold the parts therein in place and to seal the lower end portion of the housing.

The several sections of the housing H are made of a suitable, long chain polyester resin and are so engaged and welded or cemented together to establish an integrated or unitary housing structure.

The housing H includes an elongate tubular upper body section 30 with open top and bottom ends, a round substantially disk-shaped top closure part 31 engaged wih the open top of the body section 30; an elongate inverted or downwardly-opening cup-like lower body section 32 engaged in and with the lower or bottom end of the upper body section 30 to close it and define the upper chamber X and a cup-like bottom closure part 33 engaged on and about the lower open end of the lower body section 32 to define the lower chamber Y.

The upper body section 30 can be established by a suitable length of tube stock with straight, flat, annular upper and lower ends.

The top closure part 31 is a disk-shaped, molded plastic part that slidably enters the upper end of the body section 30. The part 31 has flat top and bottom surfaces 35 and 36 and a radially outwardly-projecting stop flange 37 to stop against the top end of the section 30. The flange 37 is generously radiused, as shown, to establish a gentle upper outer edge on and about the housing and to thereby prevent the housing from damaging a related waterbed mattress.

The part 31 next includes a central, vertical cylindrical shaft opening 38 and a central, upwardly-projecting, cylindrical boss 39 through which the opening 38 extends. The upper end of the boss 39 is formed with an arcuate notch 40. Finally, the part 31 has an elongate, transversely-extending extending, downwardly-opening orienting slot 41 in its bottom surface 36.

The lower body section 32 has a flat, horizontal top wall 42 with two (2) slot-like terminal posts-receiving through-openings 43, a similar oriented post-receiving opening 43' and a vertical capillary tube-receiving opening 44. The upper end portion of the cylindrical side wall of the section 32 corresponds in outside diameter with the inside diameter of the housing section 30 and is slidably engaged therein. The central portion of the section 32 is equal in outside diameter with the upper section 30. The lower end portion of the section 32 is of reduced diameter, as shown at 47, and is formed with a vertically-extending radially and downwardly-opening capillary tube-receiving slot 48.

The bottom cup-like bottom closure part 33 has a flat, horizontal bottom wall 49 with a pair of vertical through-openings 50 through which related portions of the power cord P extend and has a vent opening 51 and a filler opening 52 to facilitate the introduction of the potting material Z into the chamber Y and the evacuation of air therefrom. The part 33 has an annular side wall 53 equal in inside diameter with the outside diameter of the lower portion of the section 32 and the outside diameter of which is equal with the outside diameter of the central portion 46 of the section 32. The side wall has an upper annular edge. The part 33 is slidably-engaged on and about the lower portion of the section 32 in stopped position where the upper edge of the side wall 53 thereof is spaced below the lower end of the central portion 46 of the lower section 32 and cooperates therewith to define a radially, outwardly opening annular capillary tube-receiving channel 55. The upper end of the slot 48 in the lower body section 32 cooperates with the side wall of the lower closure part to define a radial through-opening communicating with the channel 55 and in and through which the capillary tube T extends.

The lower annular edge of the part 33 is generously radiused as clearly shown in the drawings.

The above described four parts of the housing structure H that I provide are welded and/or cemented together to establish a strong, durable, integrated or unitary housing structure.

The novel switch structure S that I provide is a manually-adjustable, normally open, over-center, snap action-type switch structure designed and constructed to be freely accommodated within the chamber X of the housing H and to be securely carried and protected thereby. The switch S includes an elongate, vertically-extending L-shaped primary frame part F with an upper horizontal foot 60 set and retained in the groove 41 in the closure part 31 and a depending leg 61 that depends longitudinally and freely downwardly from the foot and within the chamber X. The foot 60 has a vertical shaft-receiving opening 62 that is in register with the opening 38 in the part 31. The lower end of the leg 61 has a horizontal through-opening 63.

The switch S next includes an elongate, horizontal, tubular carrier part 65 with an inner end engaged through and fixed in the opening 63 in the leg 61 of the frame F and which projects outwardly from the leg, within the chamber X. The part 65 carries a dielectric insulating sleeve 66.

The switch next includes an elongate first conductor part 67 engaged about and carried by the insulating sleeve 66. The part 67 has a terminal post 68 that depends through one of the openings 46 in the housing section 32 and into the compartment or chamber Y and has an upwardly-projecting resilient arm 69 terminating in the upper portion of the compartment or chamber X. The arm 69 is formed with flat, horizontal, outwardly-projecting, vertically-spaced upper and lower flanges 70 and 71. The upper flange 70 is formed with a vertical drive pin-receiving opening 72 and with contact reed mounting means 73.

An elongate, vertically-extending, resilient conductor reed 75 is positioned in the chamber X and carried by the flanges on the arm 69. The read has an upper end mounted to the flange 70 of the arm 69 by said mounting means 73. The reed 75 depends from the flange 70 within the compartment or chamber X. Its lower end terminates above the outer end portion of the carrier part 65 and its related insulating sleeve 66. The read 75 carries a contact part 76 at its lower end.

The switch S next includes a second conductor part 77 engaged about and carried by the assembled parts 65 and 66. The part 77 has a terminal post 78 depending through the other opening 46 in the housing section 32 and into the chamber Y and a short, upwardly-projecting contact post 79 with a contact part 80 thereon.

The post 79 occurs between the lower end portion of the reed 75 and the arm 69.

The switch S next includes a stop post 81 mounted on and projecting up from the outer free end of the carrier part 65 in spaced relationship from the parts 77 and 79 and between which the lower end portion of the reed 75 occurs. The stop part 81 is shown provided with a depending orienting and anchoring post 82 engaged through the opening 43' in the top of the housing section 32.

In addition to the foregoing, the switch structure includes a plurality of annular spacers of dielectric material engaged about the insulating sleeve 66 and between the several switch parts carried thereby.

The switch S next includes an elongate, vertical, normally biased actuating leaf spring 83 with upper and lower ends. The leaf spring 83 has a lower end adjacent the contact part 76. The spring 83 is formed interedly in and with the reed 75 by a suitable piercing and forming operation which establishes an opening (not shown) in the reed through which opening the spring can freely move. The spring 83 has an upper end retained in a downwardly-opening seat in the lower flange 71 on the arm 69.

When the upper end portion of the reed 75 is forcibly moved inwardly toward the arm 69 and over center of the upper end of the spring 83, the spring 83 is biased to urge the lower end of the reed 75 outwardly toward and into engagement with the stop 81, setting the switch S in its normal open position. When the upper end of the read is let to move outwardly away from the arm 69 and over center of the upper end of the spring 83, the spring 83 is biased to urge the lower end of the read inwardly toward the contact post 79 where the contact parts 76 and 80 are engaged and the switch is in its closed position.

Figure 4:
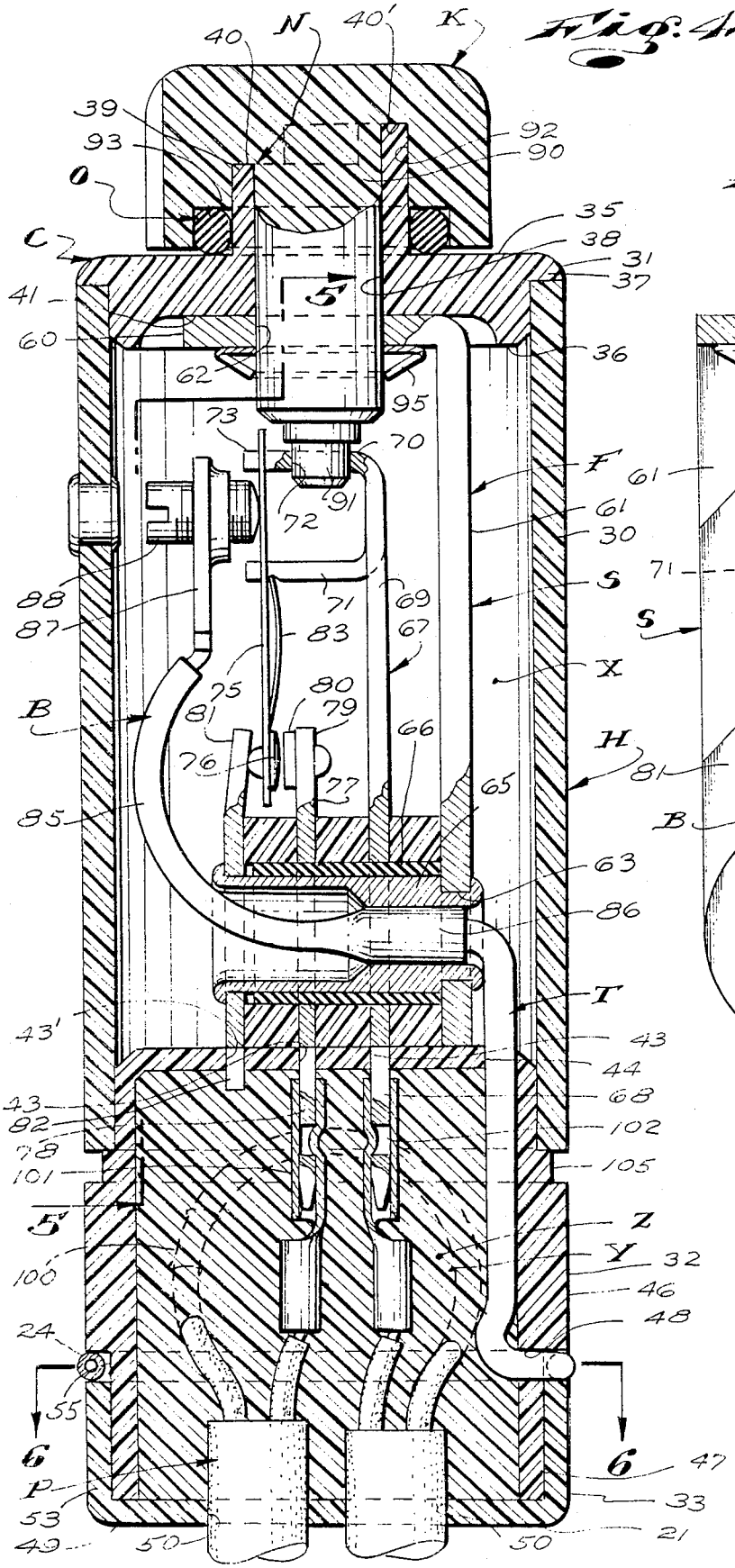
FIG. 4 is an enlarged, detailed sectional view taken substantially as indicated by line 4—4 on FIG. 3.

The switch S next includes the above noted fluid pressure-responsive switch-actuating means or device B which device is shown as an elongate, semi-circular Bourdon tube 85 with a lower inner end 86 mounted within the tubular carrier part 65 and which is connected with the upper inner end of the above referred to capillary tube T, as clearly shown in FIG. 4 of the drawings.

The semi-circular Bourdon tube 85 extends freely outwardly and upwardly through and from the carrier part 65 and freely upwardly into the compartment X and is provided at its sealed or closed upper inner free end with a plate-like drive part 87 that occurs outward of or from the upper end portion of the reed 75 and which carries an axially-adjustable, inwardly-projecting set screw 88. The screw 88 engages the outer side or surface of the reed 75 as clearly shown in FIG. 4 of the drawings.

The Bourdon tube 85, when subjected to low internal fluid pressures, is or remains tightly circularly-curved and such that the set screw 88, engaging the read 75, holds the upper end of the reed inwardly to maintain the switch in its normal open or unactuated position. When the internal pressure in the Bourdon tube is increased by thermal expansion of the fluid in the tube T and within the Bourdon tube, the Bordon tube yieldingly straightens or opens, urging the set screw outwardly relative to the reed and allowing the reed to move outward and over center of the upper end of the spring 83; whereupon the switch is moved to its closed or actuated position.

By suitably adusting the set screw 88, the Bourdon tube can be adjusted to affect movement of the switch between its opened and closed or unactuated and actuated positions when the internal pressure to which the tube is subjected is above and below a desired set pressure and corresponding temperature of its related mattress M.

The switch structure S next includes manually-operable adjusting means N comprising an elongate, vertically-extending, rotatable shaft 90 extending through the central openings 38 and 62 in the housing structure H and the foot of the frame F. The lower end of the shaft 90 depends into the chamber or compartment X and is provided with an eccentric, cylindrical drive pin 91 that is rotatably engaged in the opening 72 in the top flange 70 at the top of the resilient arm 69 of the contact part 67. Upon rotation of the shaft 90, the eccentric pin 91 functions to bias the arm 69 inwardly and outwardly and to thereby move the upper end of the reed toward or away from the set screw 88 carried by the Bourdon tube 85 and to thereby vary and/or adjust and set the operating position of the reed 75 relative to the Bourdon tube and set screw 88.

The shaft 90 has the above noted operating or adjusted knob K formed interedly with it, at its upper end. The knob K cooperates with the upper portion of the shaft to define an annulus 92 in which the cylindrical projection or boss 39 on the top closure part of the housing structure H is rotatably engaged. The upper end of the annulus is formed or notched as at 40' to cooperate with the notch 40 in the boss 39 to limit rotation of the knob K and shaft 90 relative to the housing about and preferably slightly less than one hundred eighty degrees (180°).

The top surface, at the upper end of the housing, about the outer periphery of the knob K, is provided with suitable temperature calibrations about approximately one hundred eighty degrees (180°) of its circumferential extent and the knob K is provided with an indicating mark or groove at its outer perimeter to cooperate with the calibrations and to thereby indicate the set rotative position of the shaft and pin and the resulting operating position of the read.

The bottom or underside of the knob K is provided with a downwardly and radially inwardly opening annular groove 93 disposed toward the top surface 35 of the housing H and the exterior of the boss 39 thereon and in which an annular O-ring seal O is engaged to seal between the knob and the housing and to thereby make the upper end of the controller waterproof.

The shaft 80, knob K, sealing ring, and frame F are maintained, assembled and in operating position in and relative to the housing by a gripper-type retaining washer 95 engaged about the shaft and engaging the bottom side of the foot 60 of the frame F, as clearly illustrated in the drawings.

Figure 5:
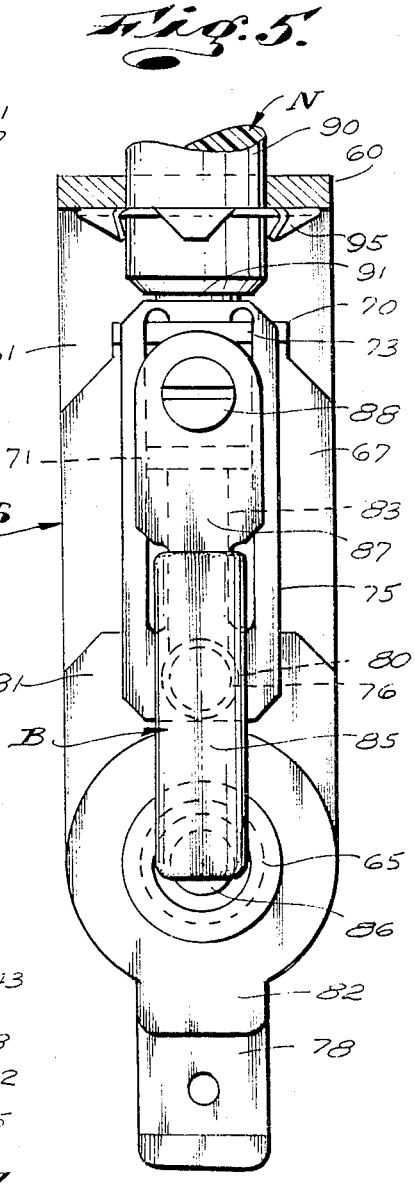
FIG. 5 is a view taken substantially as indicated by line 5—5 on FIG. 4.

The upper end portion of the capillary tube T extending from the Bourdon tube 85 is directed downwardly in the upper compartment or chamber X, through the opening 44 in the top of the housing section 32 and thence radially outward through the opening defined by the slot 48, in the side wall 53 of the housing part 33. The outer portion of the tube is then bent circularly about the exterior of and is set in retained position in the annular radially outwardly-opening groove 55 in the housing, as clearly shown in FIGS. 4 and 5 of the drawings.

The power cord P extending between the resistance heater E and the power service outlet 15 is cut between its ends where the controller housing is to be positioned and each of the two cut end portions thereof are engaged through one of the pair of openings 50 in the bottom of the housing. The cut-related ends of one of the conductors of the cord are connected together within the housing Y, as at 100, and the cut-related ends of the other conductor of the cord are connected with related terminal posts 68 and 78 of the switch structure S by suitable connectors, as shown at 101 and 102 in FIG. 4 of the drawings.

With the parts assembled and connected in the manner noted above, the compartment or chamber Y is filled with the dielectric sealing and bonding compound or potting material Z. The potting material Z is introduced into the compartment Y through the opening 52 and air in the compartment Y is displaced therefrom through the vent opening 51 in the housing.

It will be apparent that with the O-ring seal or seals at the upper end of the controller structure and the potted and sealed lower end thereof, the controller structure that I provide is a waterproof structure which can be safely used about and submerged within water and is such that it can be safely arranged and used within a waterbed structure in the manner described above and as clearly shown in FIGS. 1, 2 and 3 of the drawings.

Figure 7:
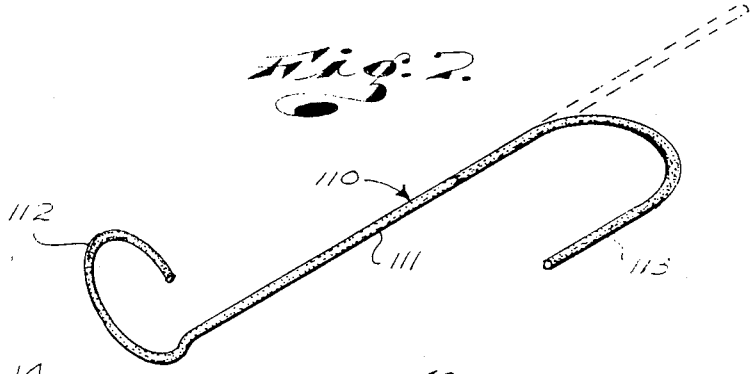
FIG. 7 is an isometric view of a hangar part.
Figure 8:
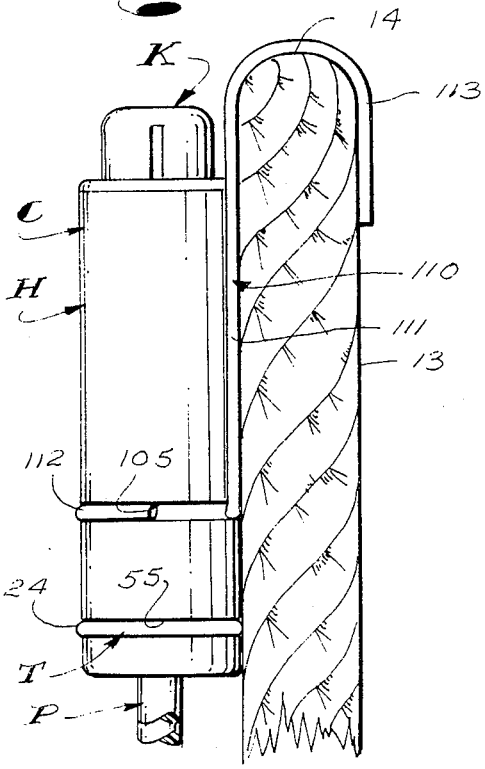
FIG. 8 is a view showing the hangar part related to my controller and to related portions of a waterbed structure; and, FIG. 9 is an elevational view of a modified embodiment of my controller.

In practice and as shown in the drawings, the sections 30 and 32 of the housing H can be formed and engaged one with the other to define a second annular radially outwardly-opening groove 105. The groove 105 is suitable for cooperatively engaging a portion of a suitable retaining for the controller. The support for the controller might be a simple cord tied about the housing and engaged over and tied off relative to the support board of the bed structure or can, as shown in FIGS. 7 and 8 of the drawings, be in the form of a simple bent wire hangar 110. The hangar 110 has a vertically-extending central portion 111, a horizontal loop 112 at its lower end, and an outwardly and downwardly-turned hook 113 at its upper end. The loop 112 at the lower end of the hangar is yieldingly engaged and retained in the groove 105 of the housing. The upper hook is engaged over the upper edge portion of the retaining board of the waterbed structure. The lower end portion and loop of the hangar can be tempered and resilient while the upper end portion thereof, including the hook, can be anealled and made malleable whereby the upper end or hook portion of the hangar can be manually formed to cooperatively engage the great majority of different sizes and makes of retaining boards in waterbed structures.

In practice, the wire hangar noted above can be coated or jacketed with a suitable soft protective plastic material.

Figure 9:
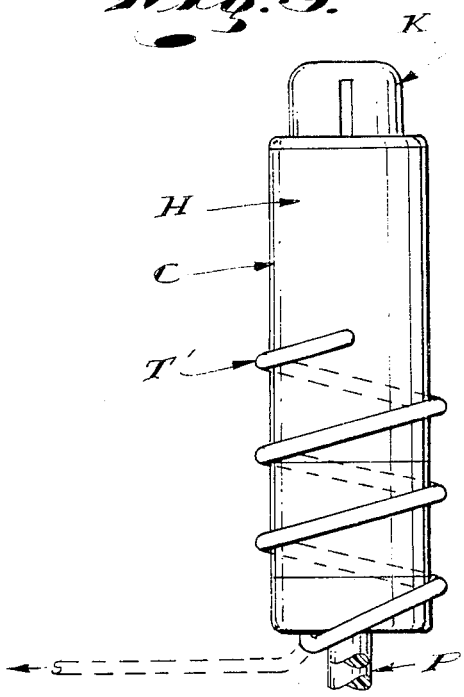

In FIG. 9 of the drawings, I have shown a slightly modified embodiment of my invention wherein the capillary tube T′ exits the bottom end of the housing H, rather than one side thereof, and wherein said tube is turned up and wound or wrapped helically upwardly about the exterior of the housing. In this embodiment of my invention, the upper terminal end of the tube T can be releasably fastened to the exterior of the housing by a deposit of silicone cement or the like and is such that, if necessary, it can be pulled free from engagement about the housing and made to extend freely therefrom, if circumstances should require or if a user determines that he would prefer to extend and string out the capillary tube when putting my new controller to use.

Figure 6:
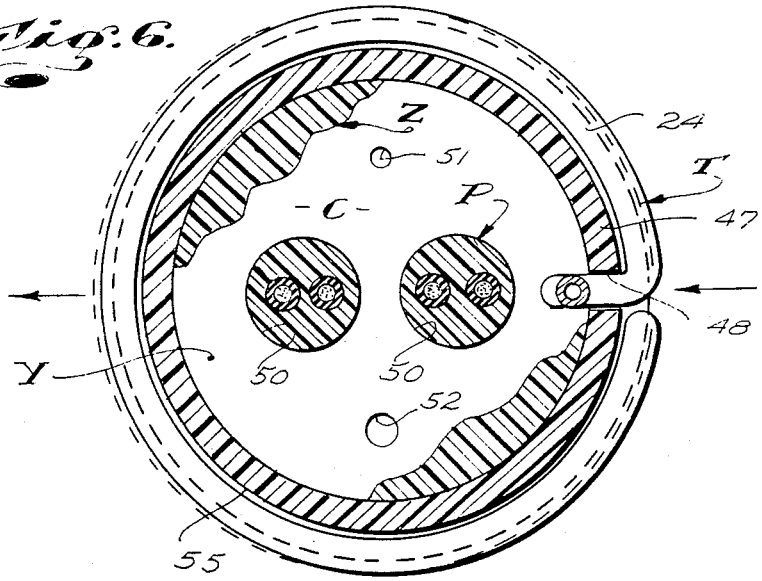
FIG. 6 is a sectional view taken substantially as indicated by line 6—6 on FIG. 5.

Referring to FIG. 6 of the drawings, it is to be noted that the annular groove 55 in which the tube T is engaged is slightly less in radial extent than the outside diameter of the tube T so that the tube T always projects therefrom a sufficient extent to assure its establishing desired contact with a related waterbed mattress. Further, an as shown, the inside diameter of the annular portion of the tube T engaged in the groove 55 is preferably slightly greater than the inside diameter of the tube so that when the controller is used as intended and one side thereof is urged into engagement with a hard or rigid supporting surface structure, such as the retaining board of a related waterbed, the circularly-formed portion of the tube is free to move eccentrically relative to the housing with the supported side thereof urged into full seated engagement in the groove and with its opposite side moved slightly outwardly from within the groove so as to expose a greater portion thereof for heat-conducting contact with its related waterbed mattress.

In addition to the above, the free "floating" relationship of the tube T in the groove 55 allows for free thermal expansion and contraction of the tube and eliminates the likelihood of distortion of that tube in such a manner as might otherwise adversely affect the pressure within the tube.

While it is preferred and while I have shown my new controller arranged vertically between and in retained-engagement between a related side and related retaining board of its related waterbed structure so that access to the control knob thereof is normally had from the top of the waterbed structure, it is possible to pre-set the control knob at a desired operating temperature and to place the controller between the bottom of the mattress and the platform of its related waterbed structure without danger or adverse affects.

In practice, if desired, the upper chamber or compartment X of my new controller can be advantageously and effectively filled with a light anhydrous oil, such as "turban oil". Such a deposit of oil within and filling the chamber Y occupies or fills that chamber and prevents the entry of water or moisture therein. Such anhydrous oils are hydrophobic and will not absorb or attract moisture. Further, such oils are dielectric and will in no way adversely affect the operation of my new switch structure.

In light of the foregoing description of my invention and its apparent operation and use, further detailed explanation and discussion of either its operation of use would only serve to unduly burden this disclosure and will not be undertaken.

Having described only typical preferred forms and embodiments of my invention, I do not wish to be limited to the specific details herein set forth but wish to reserve to myself any modifications and/or variations that might appear to those skilled in the art and which fall within the scope of the following claims.

Having described my invention, I claim:

1. In combination: a waterbed structure including a horizontal platform, a retaining frame about the perimeter of and projecting up from the platform, a soft, flexible sheet plastic bladder mattress containing a volume of water supported atop the platform and within the frame; an electric resistance heater engaged with and between the platform and the mattress to heat and maintain the mattress and the water therein, an elongate power cord with a pair of conductors connected with and extending between the heater and an electric power service outlet remote from the waterbed structure, the cord has an inner portion extending from the heater between the mattress and the platform and between the mattress and the frame, and has an outer portion extending freely from said bed structure to said service outlet; a manually- adjustable thermally-responsive temperature controller responsive to the temperature of the mattress and operating to start and stop the flow of current through the cord, said controller includes an elongate cylindrical housing with opposite ends, an adjustable on and off switch with relatively movable contact parts within the housing, a manually-engageable adjusting knob accessible at one end of the housing with a shaft entering and sealingly-engaged in the housing, said shaft has a switch-adjusting part engaged with one movable contact part of the switch, a fluid-filled Bourdon tube mounted within the housing and engaging and moving another movable contact part of the switch relative to said one movable contact part between opened and closed positions when the Bourdon tube is deflected by changes in fluid pressure therein, an elongate fluid-filled capillary tube with an inner end connected with the Bourdon tube and an outer end portion extends from within and is supported by the exterior of the housing, openings in the housing into and out of which the capillary tube and related ends of the inner and outer portions of the power cord extend, conductors of the portions of the power cord are connected with related terminal parts of said switch, the controller housing is positioned in supported engagement between an inside surface of said frame and an adjacent portion of said mattress with a portion of the capillary in heat-conducting contact with the mattress.

2. The combination set forth in claim 1 wherein the frame has upper edges on a horizontal top plane of the frame and the mattress defines vertical outside surfaces adjacent to an opposing inside surfaces of the frame, said mattress defines a top surface on a horizontal plane near the top plane of the frame, said controller is positioned and held between opposing outside and inside surfaces of the mattress and frame with its one end disposed upwardly and with said knob visible and accessible between the mattress and frame.

3. The combination set forth in claim 1 wherein the frame has upper edges on a horizontal top plane of the frame and the mattress defines vertical outside surfaces adjacent to an opposing inside surfaces of the frame, said mattress defines a top surface on a horizontal plane near the top plane of the frame, said controller is positioned and held between opposing outside and inside surfaces of the mattress and frame with its one end disposed upwardly and with said knob visible and accessible between the mattress and frame, and a hanger to support the controller in position between the mattress and frame, said hanger has an upper portion engaged with the frame and a lower hold portion engaged about said housing.

4. The combination set forth in claim 1 wherein the frame has upper edges on a horizontal top plane of the frame and the mattress defines vertical outside surfaces adjacent to an opposing inside surfaces of the frame, said mattress defines a top surface on a horizontal plane near the top plane of the frame, said controller is positioned and held between opposing outside and inside surfaces of the mattress and frame with its one end disposed upwardly and with said knob visible and accessible between the mattress and frame, and a hanger to support the controller in position between the mattress and frame, said hanger has an upper portion engaged with the frame and a lower hold portion engaged about said housing, said upper portion is a bent wire hook engaged over the edge of the frame, said holder portion is a bent wire ring-like portion engaged about the housing.

5. The combination set forth in claim 1 wherein the frame has upper edges on a horizontal top plane of the frame and the mattress defines vertical outside surfaces adjacent to an opposing inside surfaces of the frame, said mattress defines a top surfaces on a horizontal plane near the top plane of the frame, said controller is positioned and held between opposing outside and inside surfaces of the mattress and frame with its one end disposed upwardly and with said knob visible and accessible between the mattress and frame, and a hanger to support the controller in position between the mattress and frame, said hanger has an upper portion engaged with the frame and a lower holder portion engaged about said housing, said upper portion is a bent wire hook engaged over the edge of the frame, said holder portion is a bent wire ring-like portion engaged about the housing, said housing is formed with an annular radially outwardly opening groove in which said holder portion is releasably engaged.

6. The combination set forth in claim 1 wherein the frame has upper edges on a horizontal top plane of the frame and the mattress defines vertical outside surfaces adjacent to an opposing inside surfaces of the frame, said mattress defines a top surface on a horizontal plane near the top plane of the frame, said controller is positioned and held between opposing outside and inside surfaces of the mattress and frame with its one end disposed upwardly and with said knob visible and accessible between the mattress and frame, and a hanger to support the controller in position between the mattress and frame, said hanger has an upper portion engaged with the frame and a lower holder portion engaged about said housing, said upper portion is a bent wire hook engaged over the edge of the frame, said holder portion is a bent wire ring-like portion engaged about the housing, said housing is formed with an annular radially outwardly opening groove in which said holder portion is releasably engaged, the capillary tube is wound helically about the housing.

7. The combination set forth in claim 1 wherein the capillary tube is wound helically about the housing.

8. A controller for an electric resistance heater, said controller includes an elongate vertical, cylindrical housing with upper and lower ends, an adjustable on and off switch with relatively movable contact parts and with terminal parts mounted within the housing, a manually engageable adjusting knob accessible at the upper end of the housing and having a depending shaft entering and sealingly-engaged in the housing, a switch-adjusting part on the shaft engaging one movable contact part of the switch to move that part relative to another movable contact part of the switch, a Bourdon tube mounted within the housing and engaging and moving said one movable contact part to effect opening and closing of the switch when the Bourdon tube is deflected by changes of pressure therein, an elongate capillary tube with one end portion in the housing and connected with at the Bourdon tube and another end portion at the exterior of and supported by the housing, openings in the housing through which the capillary tube extends and into and out of which a portion of a related power cord to conect a remote resistance heater with a remote power service outlet extends the power cord is connected with the terminal posts in the housing.

9. The controller set forth in claim 8 wherein the housing defines an upper chamber in which relatively movable parts of the switch and in which the Bourdon tube are positioned and into which said shaft projects, the housing next includes a lower chamber with which said openings communicate and into which said terminal posts and power cord project and through which said capillary tube extends, said lower chamber is filled with a dielectric sealing compound.

10. The controller set forth in claim 8 wherein the housing defines an upper chamber in which relatively movable parts of the switch and in which the Bourdon tube are positioned and into which said shaft projects, the housing next includes a lower chamber with which said openings communicate and into which said terminal posts and power cord project and through which said capillary tube extends, said lower chamber is filled with a dielectric sealing compound, the capillary tube extends radially outward through an opening in the housing and is formed helically about and in supported engagement with the housing.

11. The controller set forth in claim 8 wherein the upper end of the housing is sealingly closed by a closure part with an upwardly projecting cylindrical boss and a central vertical through-opening through which said shaft extends, said knob has an annular groove accommodating said boss and carries an O-ring seal in sealing engagement with and between the knob and said cylindrical boss.

12. The controller set forth in claim 8 wherein the switch includes a vertically extending frame with a lower end mounted in the housing and an upper end drivingly coupled with said adjusting part, a vertical resilient conductor arm with a lower end mounted to the lower end portion of the frame, said one movable contact part has an upper portion coupled to the arm and a lower portion depending freely in the housing, said other movable contact part is mounted to the lower end portion of the frame and projects up and terminates in lateral spaced relationship from the lower portion of said one movable contact part, said terminal parts are joined with and depend from said arm and said other movable contact part, said Bourdon tube has a lower end portion mounted to the lower end portion of the frame and an upper end engaging said one movable contact part to move said one movable contact part and to cause that part to move into and out of contact with said other movable contact part when the Bourdon tube is caused to deflect.

13. The controller set forth in claim 8 wherein the switch includes a vertically extending frame with a lower end mounted in the lower end of an upper chamber defined in the housing and an upper end drivingly coupled with said adjusting part, a vertical resilient conductor arm with a lower end mounted to the lower end portion of the frame, said one movable contact part has an upper portion coupled to the arm and a lower portion depending freely in the upper chamber, another contact part is mounted to the lower end portion of the frame and projects up in the upper chamber and terminates in lateral spaced relationship from the lower portion of said one contact part, said terminal parts are joined with and depend from said arm and said other contact part, said Bourdon tube has a lower end portion mounted to the lower end portion of the frame and an upper end engaging said one movable contact part to move that part into and out of contact with said other movable contact part when the Bourdon tube is caused to deflect, the housing defines a lower chamber with which said openings communicate, into which said terminal parts and power cord project and through which the capillary tube extends, said lower chamber is filled with a dielectric sealing compound.

14. The controller set forth in claim 8 wherein the switch includes a vertically extending frame with a lower end mounted in the housing and an upper end drivingly coupled with said adjusting part, a vertical resilient conductor arm with a lower end mounted to the lower end portion of the frame, said one movable contact part has an upper portion coupled to the arm and a lower portion depending freely in the housing, said other movable contact part is mounted to the lower end portion of the frame and projects up and terminates in lateral spaced relationship from the lower portion of said one movable contact part, said terminal parts are joined with and depend from said arm and said other movable contact part, said Bourdon tube has a lower end portion mounted to the lower end portion of the frame and an upper end engaging said one movable contact part to move that part into and out of contact with said other movable contact part when the Bourdon tube is caused to deflect, the housing defines an upper chamber accommodating the movable parts of the switch and the Bourdon tube and into which said shaft projects, the housing defines a lower chamber with which said openings communicate, into which said terminal parts and power cord project and through which the capillary tube extends, said lower chamber is filled with a dielectric sealing compound, the capillary tube extends radially outward through an opening in the housing and is formed helically in supported engagement about the housing.

* * * * *